United States Patent [19]

Eberly

[11] Patent Number: 4,898,008

[45] Date of Patent: Feb. 6, 1990

[54] PADLOCK PROTECTOR

[76] Inventor: David S. Eberly, 5407 Touraine Dr., Tallahassee, Fla. 32808

[21] Appl. No.: 219,240

[22] Filed: Jul. 15, 1988

[51] Int. Cl.[4] ..... E05B 67/38

[52] U.S. Cl. ..... 70/56; 70/417; 292/DIG. 32

[58] Field of Search ..... 70/54, 55, 56, 417; 292/201, 200, 205, DIG. 32

[56] References Cited

U.S. PATENT DOCUMENTS 4,322,102 3/1982 Lindblom ..... 70/56

4,581,907 4/1986 Eberly ..... 70/54

4,760,720 8/1988 Grille ..... 70/54

*Primary Examiner*—Robert L. Wolfe

*Attorney, Agent, or Firm*—Thomas J. Dodd

[57] ABSTRACT

A padlock protector for use with swing-out type closures. The protector includes a block pivotably connected to one of the lock arm catch and closure member. The block includes peripheral flanges and a recessed body to partially surround the shackle and housing of the padlock and prevents opening thereof by cutting or prying the shackle and separating it from the housing.

1 Claim, 4 Drawing Sheets

PADLOCK PROTECTOR

SUMMARY OF THE INVENTION

This invention relates to padlock protectors and will have special but not limited application to a protector for a swing-out truck door padlock.

Padlock protectors are useful items in the cargo transportation industry and have application in other situations as well. The main purpose of the conventional padlock protector is to enshroud the most vulnerable area of the padlock, namely the shackle, to prevent cutting of the lock. Since there are a wide variety of padlocks on the market and an even wider variety of locking mechanisms, it is necessary to design padlock protectors which will work adequately with the given locking system of the truck door or other object to be locked. Prior examples of padlock protectors may be seen in my U.S. Pat. Nos. 4,506,528; 4,581,907; and in the references cited in those patents.

The padlock protector of this invention is adapted for use with a closure and lock system which employs a pivoting lock lever attached to one of the objects to be locked (usually the rear doors of a truck). The lock lever is normally received in a catch located on the other object and secured by a padlock. Conventionally, this exposed the shackle of the padlock, which allows the shackle to be cut and the doors opened without authorization.

The padlock protector includes a modified catch plate which includes a projecting lock receiving part for receiving the lock lever, and a rotatable padlock protector part secured to the catch plate or truck door. The protector part includes flanges which protect the shackle of the padlock and has a bore aligned with a bore in the catch plate lever receiving part to receive the padlock shackle. Proper entry into the truck is easily achieved by unlocking and removing the padlock and rotating the protector part away from the catch plate lever receiving part.

Accordingly, it is an object of this invention to provide for an improved device for protecting a padlock from unauthorized opening.

Another object of this invention is to provide for a padlock protector which is easily and rapidly installed and operated.

Another object of this invention is to provide for a padlock protector which protects the shackle and housing of a padlock used in swing-out type truck trailer doors.

Other objects of this invention will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
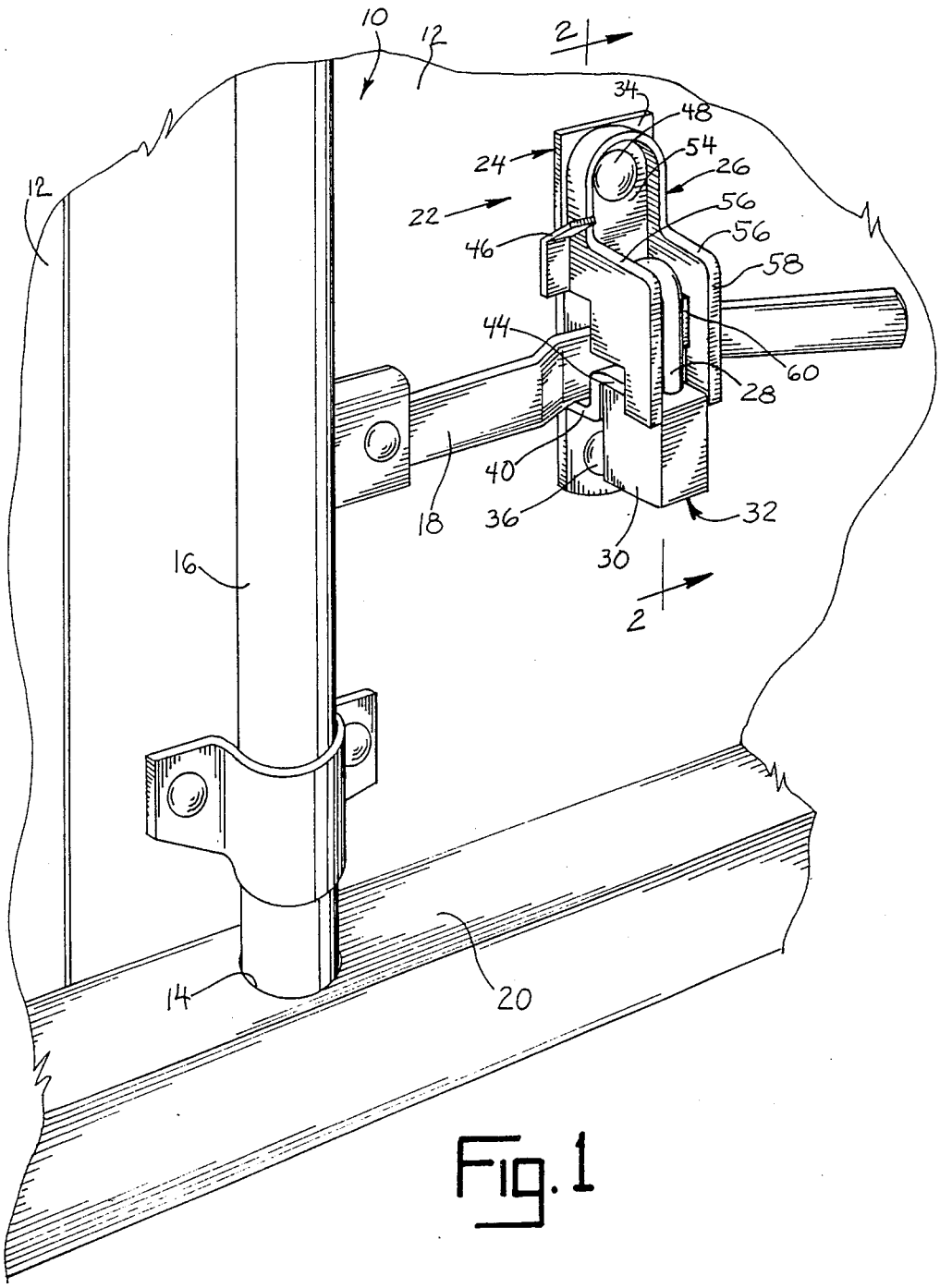
FIG. 1 is a perspective view of the padlock protector of this invention shown in use on a swing out truck door.

The preferred embodiment herein described is not intended to be exhaustive or to limit the invention to the precise form disclosed. It is chosen and described to explain the principles of the invention and its application and practical use to allow others skilled in the art to utilize the invention.

Referring now to the drawings, reference numeral 10 refers generally to the locking mechanism for a cargo hauling vehicle, commonly referred to as a semi. Locking mechanism 10 is used to lock a pair of swing-out type doors 12 (only one shown) which pivot outwardly from their inner edges to expose the cargo hauling bay (not shown). Locking mechanism 10 includes a vertical locking rod 16 operatively connected to a horizontal pivotal lock arm 18. Locking rod 16 has a locked orientation fitted into a slot peripheral flange or bumper 20 of a semi body. The functioning of locking rod 16 and lock arm 18 is conventional and will not be described in detail here. It should be noted that preferably each door 12 will be equipped with its own locking mechanism 10 as shown in the drawings.

Padlock protector 22 includes generally a catch 24 and a protector part or block 26 which is designed to protect shackle 28 and housing 30 of a conventional padlock 32.

Catch 24 includes a catch plate 34 which is connected to door 12 as by bolt 36 and nut 38. Catch plate 34 defines an integral channel part 40 which projects outwadly and upwardly from the catch plate. Channel part 40 has a bore 42 through its upper flange 44 as shown. A restrictor tab 46 is formed at one side edge of catch plate 34 as shown.

Figure 2:
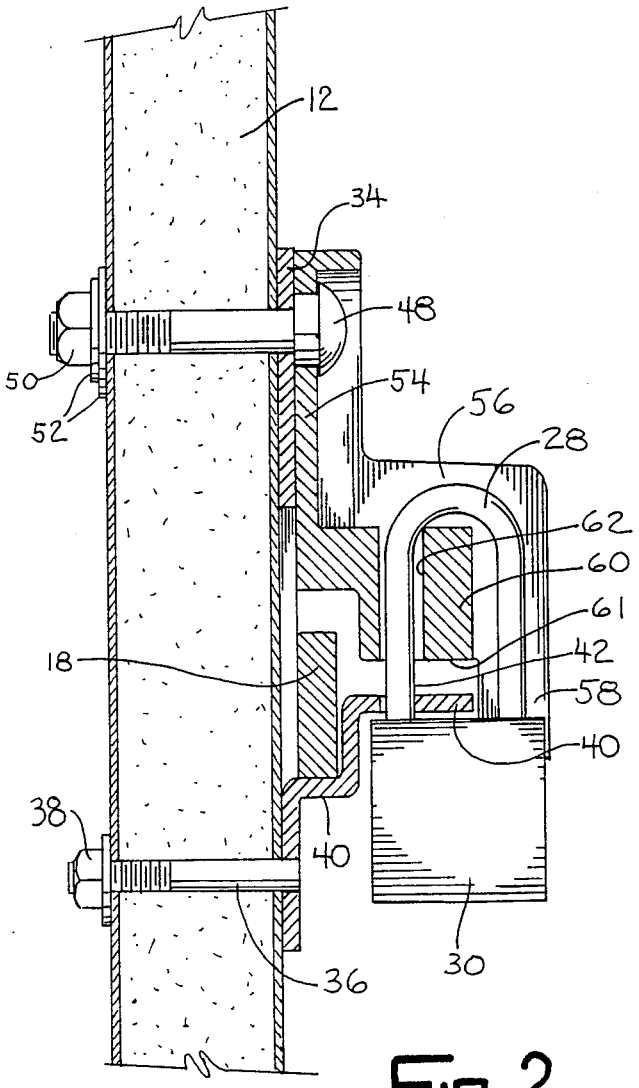
FIG. 2 is a sectional view taken along line 2—2 of FIG. 1.

Block 26 is preferably formed or cast as a single piece of material and is rotatably connected to door 12 by bolt 48, nut 50 and washers 52. Bolt 48 also extends through catch plate 34. Block 26 is preferably shaped like a high back chair with the rear legs cut off as shown in the drawings. Block 26 includes an upright head portion 54, peripheral horizontal arms 56, and depending peripheral legs 58. A body 60 is recessed from arms 56 and legs 58 as shown and has a bore 62 therethrough which is alignable with bore 42 of channel part 40. Bores 42, 62 define a passageway through which padlock shackle 28 is passed to secure lock mechanism arm 18 in the locked position of FIGS. 1 and 2.

Figure 3:
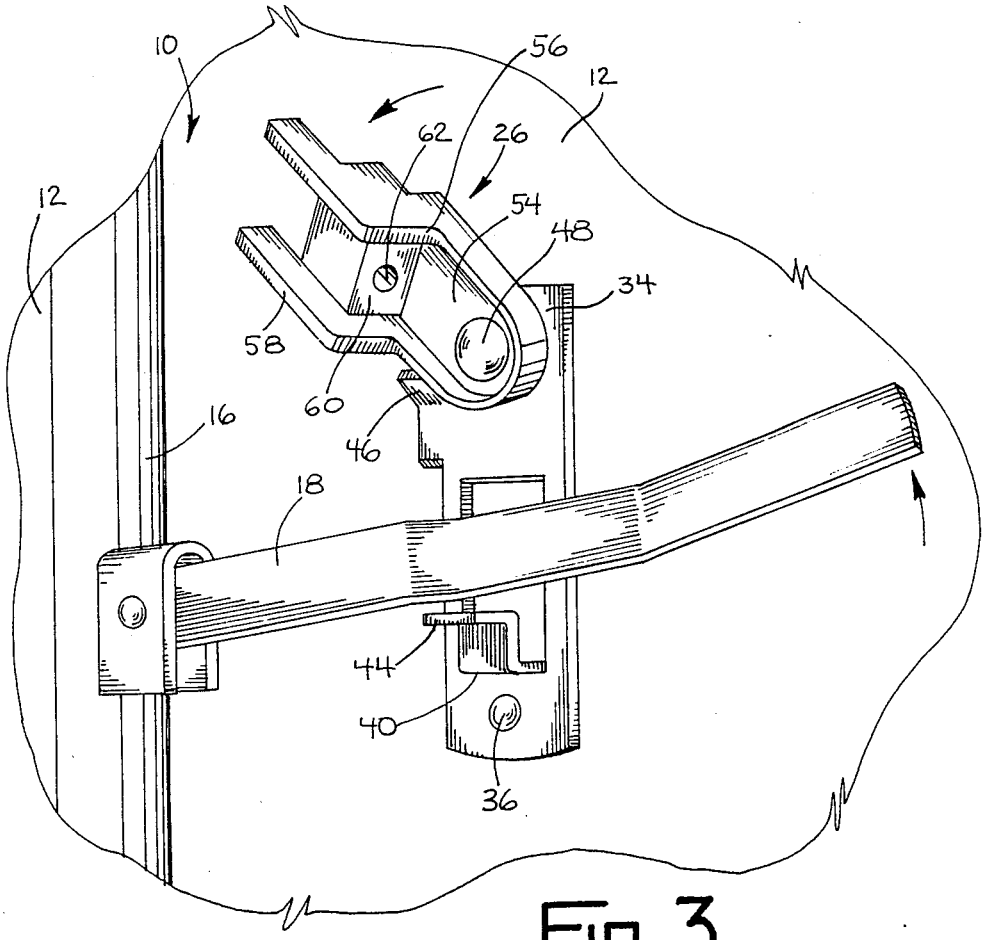
FIG. 3 is a perspective view of the padlock protector with the truck door in an unlocked position.
Figure 4:
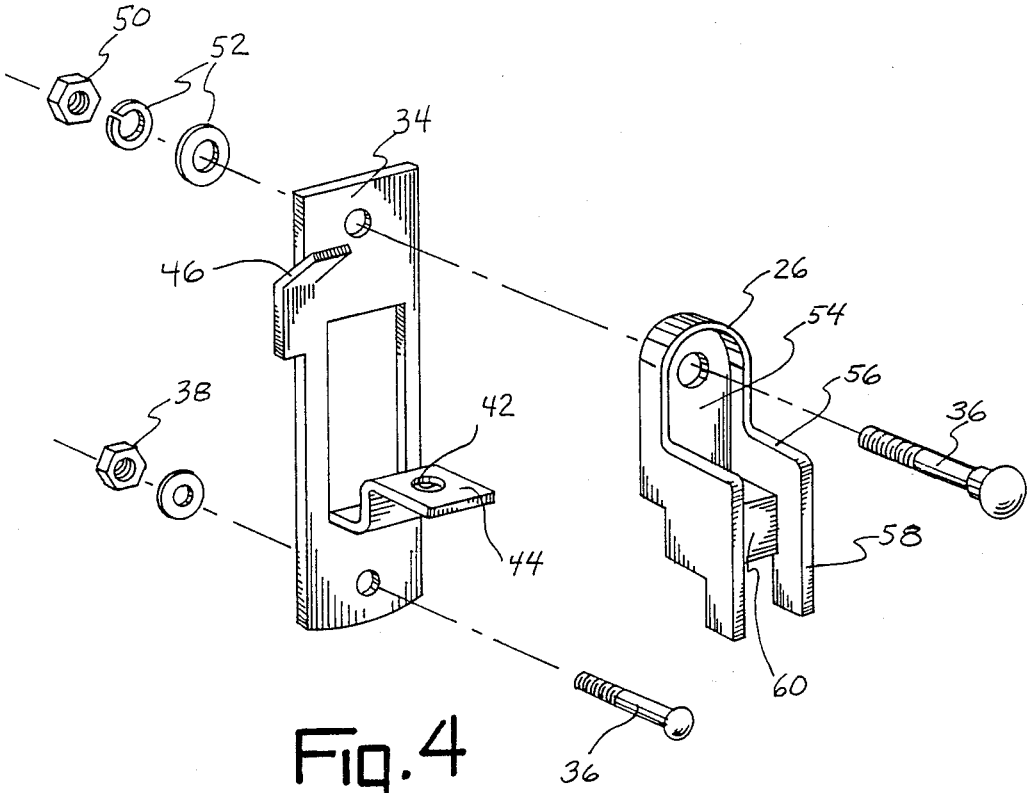
FIG. 4 is an exploded view of the padlock protector.

In operation, lock mechanism 10 and padlock protector 22 function as follows. With the truck doors 12 in the open position, a user pivots the doors into their closed position and pivots each lock arm 18 until the lock arm is positioned above channel part 40 (FIG. 3). Lock arm 18 is then positioned in channel 40 with locking rod 16 fitting into slot 14 to lock doors 12. Block 26 is then rotated clockwise until bores 42, 62 are aligned. In this position, bottom edge 61 of body 60 is positioned adjacent to channel part flange 44. Padlock 32 is then installed by inserting shackle 28 through bores 42, 62 and pressing the shackle into padlock housing 30. Arms 56 and legs 58 of block 26 partially surround shackle 28 and housing 30 of padlock 32 to prevent the lock from being opened or breached by cutters, pry bars, or other burglar tools.

To open doors 12, padlock 32 is opened by a key (not shown) and removed. Block 26 is rotated counterclockwise until head 54 contacts tab 46. Lock arm 18 is then raised out of channel 41 and pivoted until locking rod 16 is withdrawn from its slot 14. Doors 12 may then be opened.

It is understood that the invention is not limited to the details above given, but may be modified within the scope of the following claims.

I claim:

1. In combination, a swing-out closure member, a locking mechanism for said closure member, and a padlock protector, said locking mechanism including rod means shiftable between a locked position and an unlocked position, lever means pivotably connected to said rod means for shifting said rod means between its said locked and unlocked positions, a catch secured to said closure member, said catch including channel means for receiving and holding said lever means and having a bored flange, and a padlock having a housing and a retractable protruding shackle, said padlock protector including a block rotatably connected to one of said catch and closure member, said block including head part and a body, and continuous outer peripheral flanges extending outwardly of said body wherein the body is recessed between said flanges, said body having a bore therethrough for aligning with said channel part flange bore to house said padlock shackle, said flanges constituting means for partially surrounding said padlock shackle and housing to prevent unauthorized opening of said padlock and the closure member when in its locked position.

* * * * *